United States Patent [19]

Imamura et al.

[11] 4,247,408

[45] Jan. 27, 1981

[54] ACIDIC LIQUID DETERGENT COMPOSITION FOR CLEANING HARD SURFACES CONTAINING POLYOXYALKYLENE ALKYL ETHER SOLVENT

[75] Inventors: Tetsuya Imamura, Tokyo; Ryoji Shiozaki, Funabashi, both of Japan

[73] Assignee: Kao Soap Co., Ltd., Tokyo, Japan

[21] Appl. No.: 41,799

[22] Filed: May 23, 1979

[30] Foreign Application Priority Data

Jun. 5, 1978 [JP] Japan ..... 53/67531

[51] Int. Cl.[3] ..... C11D 7/08; C11D 3/43; C11D 3/20; C11D 7/50

[52] U.S. Cl. ..... 252/143; 252/136; 252/170; 252/DIG. 14

[58] Field of Search ..... 252/143, 170, 139, 136, 252/142, 558, 539, DIG. 14

[56] References Cited

U.S. PATENT DOCUMENTS

| | | | |
|---|---|---|---|
| 3,239,467 | 3/1966 | Lipinski | 252/143 X |
| 4,013,579 | 3/1977 | Nakasone et al. | 252/143 |

*Primary Examiner*—Harris A. Pitlick

*Attorney, Agent, or Firm*—Blanchard, Flynn, Thiel, Boutell & Tanis

[57] ABSTRACT

A weakly acidic or acidic liquid detergent composition comprising a water-soluble solvent, an anionic and/or nonionic surfactant, an acidic substance or a mixture of acidic substance and water-soluble salt thereof, wherein said water-soluble solvent has the formula $$RO(C_2H_4O)_x(C_3H_6O)_yR'$$

wherein R and R′ are hydrogen, methyl or ethyl, with the proviso that R and R′ are not hydrogen simultaneously, the sum of x plus y is from 3.0 to 10 and $0 \leqq x \leqq 0.25y$.

4 Claims, No Drawings

ACIDIC LIQUID DETERGENT COMPOSITION FOR CLEANING HARD SURFACES CONTAINING POLYOXYALKYLENE ALKYL ETHER SOLVENT

The present invention relates to a weakly acidic or acidic liquid detergent composition. More particularly, the invention relates to a weakly acidic or acidic detergent composition comprising a water-soluble solvent, an anionic surface active agent, and an acidic substance or an acidic substance and a water-soluble salt thereof.

Various organic and inorganic soils such as fatty acid metal salts (especially alkaline earth metal salts), calcium phosphate, oils and decomposed proteins adhere to surfaces in bathrooms and toilets. A weakly acidic or acidic detergent comprising a water-soluble solvent, an acidic substance and a surface active agent is effective for removing these soils. The water-soluble solvent has a function of emulsifying and dissolving organic soils and also has an effect of maintaining the detergent composition in a uniform stable liquid state. However, the solvents customarily used in this field have a strong solvent odor, and when they are used in a relatively small confined room, such as a bathroom or a toilet, discomfort is caused by this strong odor. Therefore, development of improved water-soluble solvents for this type of liquid detergent composition has been eagerly desired. As the water-soluble solvents customarily used in this field, there can be mentioned, for example, lower alkyl ethers of ethylene glycol and diethylene glycol. Among these ethers, diethylene glycol monobutyl ether is satisfactory as regards the function of emulsifying and dissolving organic soils, but the odor of unreacted butyl alcohol which is present in a very small amount and the odor of ethylene glycol monobutyl ether, which also is present, are very offensive and these odors cannot be sufficiently removed even if the solvent is passed through a special purifying step. A methyl or ethyl ether of ethylene glycol or diethylene glycol does not cause a problem of solvent odor, but it is insufficient in the necessary function of emulsifying and dissolving organic soils and in the cleaning power. Accordingly, such solvent is not suitable as a component of a liquid detergent composition of this type.

It is a primary object of the present invention to provide a weakly acidic or acidic liquid detergent composition comprising a water-soluble solvent which is satisfactory not only as regards its odor but also as regards its cleaning characteristics.

We have discovered a liquid detergent composition containing a water-soluble solvent which possesses an excellent odor as well as an excellent cleaning power. We have an unexpectedly found that a water-soluble solvent represented by the following general formula (1):

$$RO(C_2H_4O)_x(C_3H_6O)_yR' \quad (1)$$

wherein R and R' stand for a hydrogen atom, a methyl group or an ethyl group with the proviso that the case where both of R and R' are hydrogen atoms is excluded, and the oxyalkylene groups have such a certain distribution that the mean value of $(x+y)$ is from 3.0 to 10.0, preferably 3.5 to 6.0, and the relation of $0.0 \leqq x \leqq 0.25y$ is established, is very excellent in both the foregoing properties. We have completed the present invention based on this finding.

The weakly acidic or acidic liquid detergent composition of the present invention comprises a solvent represented by the above general formula (1), an anionic surface active agent and/or a nonionic surface active agent, and an acidic substance or a mixture of an acidic substance and a water-soluble salt thereof.

As the anionic surface active agent, there can be used ordinary sulfonate type anionic surface active agents and sulfate type anionic surface active agents. As the sulfonate type anionic surface active agent, there can be mentioned, for example, salts of linear or branched alkyl ($C_8$–$C_{22}$) benzenesulfonates, salts of long-chain alkyl ($C_8$–$C_{22}$) sulfonates, and salts of long-chain olefin ($C_8$–$C_{22}$) sulfonates. As the sulfate type anionic surface active agent, there can be mentioned, for example, salts of long-chain monoalkyl ($C_8$–$C_{22}$) sulfates, salts of polyoxyethylene (1–6 moles) long-chain alkyl ($C_8$–$C_{22}$) ether sulfates, and salts of polyoxyethylene (1–6 moles) alkyl ($C_8$–$C_{18}$) phenyl ether sulfates. As the cation acting as the counter ion of such anionic surface active agent, there can be mentioned, for example, alkali metal ions such as sodium and potassium, and alkanolamine ions such as monoethanolamine, diethanolamine and triethanolamine. From the viewpoint of resistance to hydrolysis, a sulfonate type surface active agent is preferred as the anionic surface active agent, and from the viewpoint of the washing power, a salt of a linear or branched alkyl benzenesulfonate is preferred.

As the nonionic surface active agent, there can be mentioned, for example, polyoxyethylene (6–35 moles) long-chain primary or secondary alkyl ($C_8$–$C_{22}$) ethers, polyoxyethylene (6–35 moles) alkyl ($C_8$–$C_{18}$) phenyl ethers, and polyoxyethylene/polyoxypropylene block copolymers.

As the acidic substance, there can be mentioned, for example, conventional organic acids such as citric acid, oxalic acid, glycolic acid, malic acid, ethylenediamine tetra-acetic acid, hydroxyethylenediamine triacetic acid and sulfamic acid, and conventional inorganic acids such as hydrochloric acid, phosphoric acid, condensed phosphoric acid and sulfuric acid. As the water-soluble salt of the acidic substance, there can be mentioned, for example, alkali metal, ammonium and lower alkanolamine salts of these organic and inorganic acids. In a liquid detergent composition for cleaning a bathroom, citric acid, condensed phosphoric acid and ethylenediamine tetra-acetic acid are preferred. In a liquid detergent composition for cleaning a toilet, hydrochloric acid and sulfuric acid are preferred.

The amounts of the respective ingredients in the liquid detergent composition of the present invention are as follows (all references to "%" mean % by weight):

(A) Water-soluble solvent of the general formula (1): 0.1 to 20%, preferably 3 to 10%

(B) Anionic surface active agent and/or nonionic surface active agent: 0.1 to 10%, preferably 1 to 7%

(C) Acidic substance or mixture of acidic substance and water-soluble salt thereof: 0.1 to 20%, preferably 1 to 10%

In addition to the foregoing critical components, the balance of the composition is essentially water, so that the composition is a liquid. Furthermore, minor amounts of a lower alcohol such as ethyl alcohol or propyl alcohol or a lower alkyl benzenesulfonate such as benzenesulfonate, toluenesulfonate or xylenesulfonate may be added to the composition as a low temperature stabilizer. Moreover, minor amounts of a perfume, a dye, an anticorrosive agent and/or a fungicide may be incorporated in the composition so as to enhance its commercial value.

The weakly acidic or acidic liquid detergent composition of the present invention comprising a water-soluble solvent represented by the general formula (1), an anionic surface active agent and/or a nonionic surface active agent, and an acidic substance or a mixture of an acidic substance and a water-soluble salt thereof, has the effect of removing various soils in bathrooms and toilets and is advantageous because it has a good smell.

The present invention will now be further described in detail by reference to the following illustrative Examples that by no means limit the scope of the invention.

EXAMPLE 1

Various water-soluble solvents alone were tested with respect to the function of dissolving organic soils and their odors were evaluated. The results obtained are shown in Table 1.

TABLE 1

| Water-Soluble Solvent | Function of Dissolving Organic Soils | Odor |
|---|---|---|
| Present Invention | | |
| $CH_3O(PO)_{3.0}H$ | ○ | ○ |
| $CH_3O(PO)_{4.0}H$ | ○ | ○ |
| $CH_3O(PO)_{6.0}H$ | ○ | ○ |
| $CH_3O(PO)_{8.0}H$ | ○ | ○ |
| $CH_3O(PO)_{10.0}H$ | ○ | ○ |
| $CH_3O(PO)_{4.0}CH_3$ | ○ | ○ |
| $CH_3O(EO)_{1.0}(PO)_{4.0}H$ | ○ | ○ |
| $C_2H_5O(EO)_{1.0}(PO)_{4.0}H$ | ○ | ○ |
| $CH_3O(EO)_{1.5}(PO)_{7.0}H$ | ○ | ○ |
| Comparison | | |
| $C_2H_5OCH_2CH_2OH$ | X | ○ |
| $C_4H_9OCH_2CH_2OH$ | ○ | X |
| $CH_3O(PO)_{2.0}H$ | Δ | Δ |
| $CH_3O(PO)_{15}H$ | ○ | ○ |
| $CH_3O(EO)_{2.5}(PO)_{2.5}H$ | X | ○ |
| $CH_3O(EO)_5(PO)_2H$ | X | ○ |
| $CH_3O(EO)_{1.5}(PO)_4H$ | Δ | ○ |

Note
PO: propylene oxide
EO: ethylene oxide

Description of Test for Evaluating Function of Dissolving Organic Soils:

Into a test tube was placed 0.1 g of an ordinary organic soil (soil that adhered to a plastic tub in a bathroom and which was composed mainly of calcium salt of fatty acid), and 10 ml of the water-soluble solvent was added thereto. The test tube was reciprocatively shaken for a total of 10 reciprocations at an amplitude of about 20 cm. The state of emulsification or dissolution of the soil was examined with the naked eye and it was evaluated according to the following criteria:

: soil was completely emulsified or dissolved

Δ: a significant amount of unemulsified or undissolved soil was observed

X: the soil was not appreciably emulsified or dissolved.

Odor:

The odor was organoleptically tested by three experts and twenty housewives, and the results were collectively judged according to the following criteria:

: good, 3 experts and at least 19 housewives considered that the odor was good

Δ: slightly bad, 3 experts and 10 to 18 housewives considered that the odor was good X: bad, all solvents other than those ranked and Δ

$CH_3O(PO)_{15}H$ was excellent in the organic soil dissolving property and the odor, but the water-solubility thereof was poor. When this solvent was used, a uniform transparent detergent composition was not formed. Accordingly, it was found that this latter solvent is not suitable as a component of a liquid detergent composition.

EXAMPLE 2

The effect of removing fecal soil adhering to a toilet stool was examined. The results obtained are shown in Table 2.

TABLE 2

| Composition (% by weight) | Present Invention | Comparison |
|---|---|---|
| $C_2H_5O(PO)_{4.5}H$ | 7 | |
| diethylene glycol monobutyl ether $C_4H_9O(EO)_2H$ | | 7 |
| hydrochloric acid | 9 | 9 |
| polyoxyethylene (8 moles on average) lauryl ether | 1 | 1 |
| water | 83 | 83 |
| fecal soil washing power* | completely removed | non-uniform removal |

*The detergent was sprinkled on fecal soil adhering to a toilet stool of a house and cleaning was carried out with a nylon scrubbing brush, and the cleaned state was examined.

EXAMPLE 3

Various detergents were tested with respect to their effects of cleaning a bathroom. The results obtained are shown in Table 3.

TABLE 3

| Composition (% by weight) | Present Invention | | | | Comparison | | | | | |
|---|---|---|---|---|---|---|---|---|---|---|
| $CH_3O(PO)_{4.0}C_2H_5$ | 5 | | 3 | | | | | | | |
| $C_2H_5O(EO)_{1.0}(PO)_{4.0}H$ | | 4 | 3 | 10 | | 4 | 4 | | | |
| ethylene glycol monoethyl ether $[C_2H_5OC_2H_4OH]$ | | | | | 10 | | | | commercial bathroom detergent (neutral) | commercial bathroom detergent (weakly acidic) |
| sodium linear alkyl ($\overline{C}$ = 12) benzenesulfonate | 1 | 2 | | 2 | 2 | 2 | | 2 | | |
| polyoxyethylene (10 moles on average) secondary alkyl ($\overline{C}$ = 13) ether | 1 | | 1.5 | | | | | | | |
| citric acid | 3 | 10 | | 6 | 5 | 10 | 10 | | | |
| ethylenediamine tetra-acetic acid | | | 10 | | | | | | | |
| sodium malate | | | | 1 | | | | | | |
| water | 90 | 84 | 82.5 | 81 | 83 | 88 | 86 | 94 | | |
| power of cleaning bathroom soils | | | | | Δ | X | Δ | Δ | X | Δ |
| odor | | | | | | | | | | Δ* |

Note
*A residual solvent smell was noted.

Description of Test for Evaluating Power of Cleaning Bathroom Soils:

A polypropylene bath tub to which were adhered soils that could not be removed by ordinary rubbing was rubbed with a sponge impregnated with the detergent. The washing effect was examined with the naked eye and was evaluated according to the following scale:

: completely removed

Δ: non-uniform removal

X: hardly removed

The embodiments of the invention in which an exclusive property or privilege is claimed are defined as follows:

1. A weakly acidic or acidic liquid detergent composition consisting essentially of:

(A) 0.1 to 20% by weight of one or a mixture of two or more water-soluble solvents having the formula:

$$RO(C_2H_4O)_x(C_3H_6O)_yR'$$

wherein R and R' are hydrogen, methyl or ethyl, with the proviso that both of R and R' are not hydrogen simultaneously, the mean value of x plus y is from 3.5 to 6.0 and $0.0 \leqq x \leqq 0.25y$, (B) 0.1 to 10% by weight of water-soluble, synthetic, anionic, organic surfactant, water-soluble, synthetic, nonionic, organic surfactant, or mixture thereof, (C) 0.1 to 20% by weight of water-soluble acidic substance or a mixture of water-soluble acidic substance and water-soluble salt thereof, and (D) the balance is essentially water.

2. A liquid detergent composition as set forth in claim 1 wherein the acidic substance is selected from the group consisting of citric acid, malic acid, condensed phosphoric acid, ethylenediamine tetra-acetic acid, hydroxyethylenediamine tri-acetic acid, sulfamic acid, hydrochloric acid and phosphoric acid, and the water-soluble salt is selected from the group consisting of alkali metal salts of said acidic substance.

3. A liquid detergent composition as set forth in claim 1 wherein the component (B) is a sulfonate type anionic surface active agent.

4. A liquid detergent composition as set forth in claim 3 wherein the sulfonate type anionic surface active agent is an alkali metal salt of a linear alkyl benzenesulfonate.

* * * * *